US007922943B2

(12) United States Patent
Gerking

(10) Patent No.: US 7,922,943 B2
(45) **Date of Patent: *Apr. 12, 2011**

(54) METHOD AND DEVICE FOR PRODUCING SUBSTANTIALLY ENDLESS FINE THREADS

(76) Inventor: Luder Gerking, Berlin (DE)

( * ) Notice: Subject to any disclaimer, the term of this patent is extended or adjusted under 35 U.S.C. 154(b) by 1101 days.

This patent is subject to a terminal disclaimer.

(21) Appl. No.: 10/451,327

(22) PCT Filed: Dec. 21, 2001

(86) PCT No.: PCT/EP01/15136

§ 371 (c)(1),
(2), (4) Date: Dec. 16, 2003

(87) PCT Pub. No.: WO02/052070

PCT Pub. Date: Jul. 4, 2002

(65) Prior Publication Data

US 2004/0099981 A1 May 27, 2004

(30) Foreign Application Priority Data

Dec. 22, 2000 (DE) ..... 100 65 859

(51) Int. Cl.

| | |
|---|---|
| ***D01D 5/04*** | (2006.01) |
| *D04H 3/03* | (2006.01) |
| *D01D 4/00* | (2006.01) |
| *D01D 4/02* | (2006.01) |
| *D04H 3/02* | (2006.01) |
| *D04H 3/16* | (2006.01) |
| *D01F 2/00* | (2006.01) |

(52) U.S. Cl. ..... 264/40.1; 264/555

(58) Field of Classification Search ..... 264/40.3, 264/555

See application file for complete search history.

(56) References Cited

U.S. PATENT DOCUMENTS 4,472,329 A 9/1984 Muschelknautz et al.
4,710,336 A * 12/1987 Credali et al. ..... 264/172.15
5,075,161 A 12/1991 Nyssen et al.
5,260,003 A * 11/1993 Nyssen et al. ..... 264/6

(Continued)

FOREIGN PATENT DOCUMENTS

DE 3145011 A1 5/1983

(Continued)

OTHER PUBLICATIONS

Phyllis G. Torora et al., Understanding Textiles, 1997, Merril/Prentice-Hall, Inc./Simon & Shuster/A Viacom Company, Fifth Edition, p. 330.*

*Primary Examiner* — Christina Johnson
*Assistant Examiner* — Patrick Butler
(74) *Attorney, Agent, or Firm* — Barnes & Thornburg LLP

(57) ABSTRACT

The invention relates to a method and a device for producing substantially endless fine threads from polymer solutions, especially spinning material for lyocell, wherein the spinning material is spun from at least one spinning hole or a spinning slot. The spun thread or film is drawn by high-speed accelerated gas flows using a Laval nozzle whose narrowest cross-section is located beneath the point where the spinning material exists. The threads are arranged on a strip in the form of a non-woven or are taken up in the form of a yarn and are subsequently separated in spinning baths by means of solvents.

11 Claims, 3 Drawing Sheets

U.S. PATENT DOCUMENTS

Figure 1:
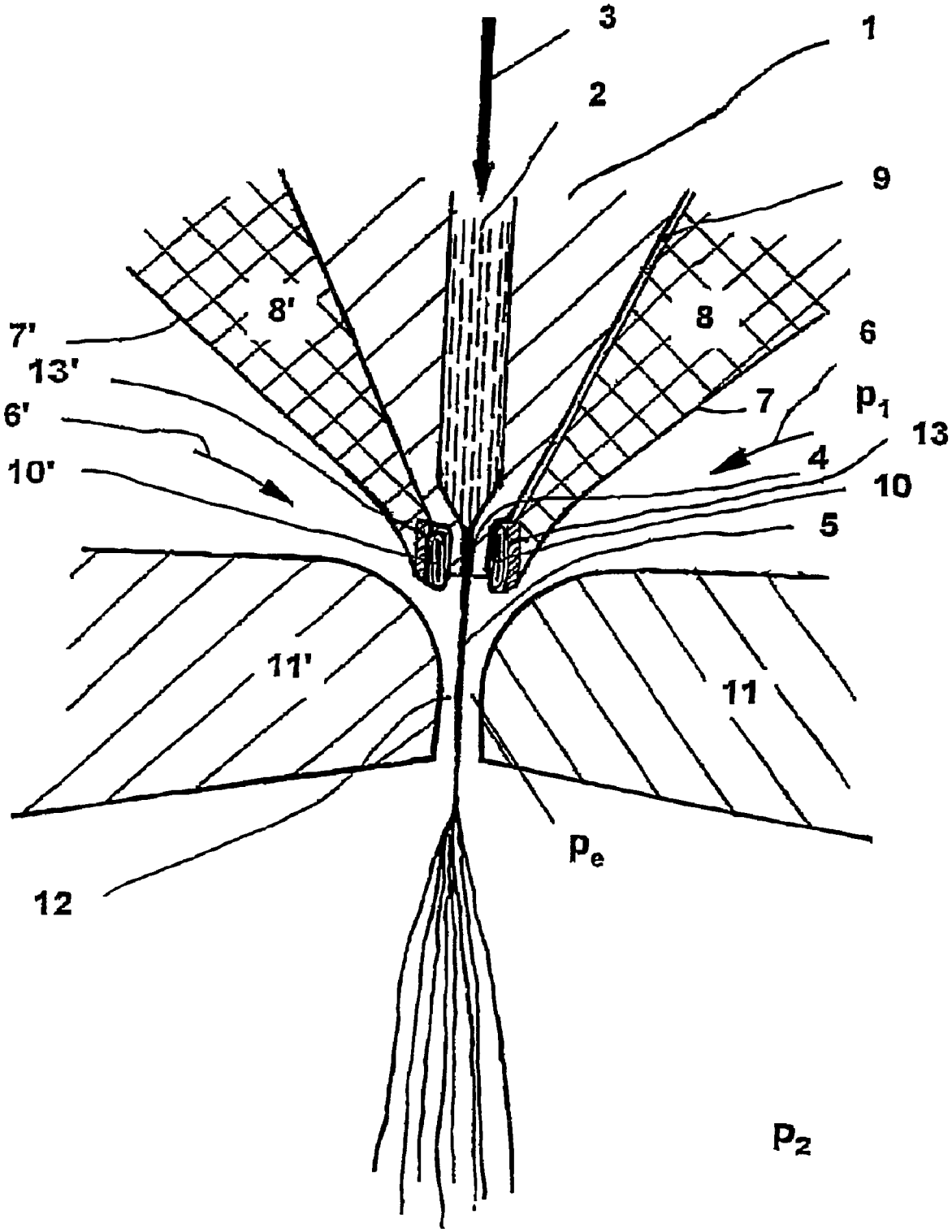

| | | | | |
|---|---|---|---|---|
| 5,439,364 | A | 8/1995 | Gerking | |
| 6,197,230 | B1 | 3/2001 | Pierre et al. | |
| 6,800,226 | B1 * | 10/2004 | Gerking | 264/40.3 |

FOREIGN PATENT DOCUMENTS

| | | | |
|---|---|---|---|
| DE | 3810596 | A1 | 10/1989 |
| DE | 4236514 | A1 | 4/1994 |
| DE | 199 29 709 | C2 | 7/2001 |
| EP | 0 908 451 | A1 * | 4/1999 |
| FR | 2735794 | | 12/1996 |
| WO | WO 97/01660 | | 1/1997 |
| WO | WO 98/07911 | | 2/1998 |
| WO | WO 98/26122 | | 6/1998 |
| WO | WO 99/47733 | | 9/1999 |
| WO | WO 99/64649 | | 12/1999 |
| WO | WO 01/00909 | | 1/2001 |

* cited by examiner

METHOD AND DEVICE FOR PRODUCING SUBSTANTIALLY ENDLESS FINE THREADS

CROSS-REFERENCE TO RELATED APPLICATIONS

This application is a U.S. national counterpart application of international application serial no. PCT/EP01/15136 filed Dec. 21, 2001, which claims priority to German application serial no. 100 65 859.8 filed Dec. 22, 2000.

BACKGROUND AND SUMMARY OF THE INVENTION

The invention relates to a method for producing fine threads from solutions of polymers of natural or synthetic origin and devices for the production thereof.

Fine threads, also termed microthreads, mainly however microfibres of finite length, have been produced for many years according to a hot air blown spinning method, the so-called meltblown method, and there are various devices for this purpose nowadays. They all have in common that, next to a row of melt borings—also a plurality of rows which are parallel to each other have become known—hot air exits which draws the threads. By mixing with the colder ambient air, the result is cooling and solidifying of these threads or fibres of finite length because often, generally in fact without being desired, the threads tears The disadvantage of these meltblown methods is the high energy outlay for heating the hot air flowing at high speed, a limited throughput through the individual spinning borings (even when these were set increasingly more densely in the course of time, up to a spacing of below 0.6 mm in the case of 0.25 mm in the hole diameter), that the result is tears in the case of thread diameters below 3 μm, which leads to beads and protruding fibres in the subsequent textile composite, and that the polymers are thermally damaged by the high air temperature, significantly above the melt temperature, which is required for producing fine threads. The spinning nozzles, a large number of which has been proposed and also protected, are complex injection tools which must be manufactured to a high precision. They are expensive, subject to faults in operation and complex to clean.

Meltblown methods of this type have also become known for the formation of fibres of finite length made of lyocell materials, i.e. spun from a solvent, generally NMMO (N-methylmorpholine-N-oxide), of dissolved cellulose, e.g. WO 98/26122, WO98/07911, WO99/47733.

In the French patent specification 2 735 794, a method is described in which a cellulose material from one or more spinning borings is split into individual particles by bursting (éclatement) and these are drawn by the gas flow into fibres of finite length. The process of fibre formation takes place in turbulent flow conditions.

A predominant problem when spinning lyocell threads from solution materials is the spinning reliability. Undissolved particles or materials enriched unequally with cellulose lead to thread tears, as a result of which particular care must be taken to avoid these two determining parameters. This leads to special embodiments of the devices, demands on the ambient conditions and a spinning method which must be implemented within narrow limits and hence is sensitive.

The object underlying the present invention is therefore to produce improved methods and devices for producing fine threads from solutions of polymers, which threads are substantially endless, are not thermally damaged by the gas flows drawing them, require a low energy outlay and can be produced by a spinning tool which is simple in its construction.

In the German patent DE 199 29 709 C2, a method and devices is described, according to which substantially endless threads are produced from polymer melts. The molten-liquid polymer threads exit from spinning borings which are disposed in one or more parallel rows or rings and enter into a chamber of a specific pressure, which is filled with gas, generally with air, and is separated from the surroundings, and they proceed into an area of rapid acceleration of this gas at the outlet from the chamber, said outlet being configured as a Laval nozzle.

The forces transmitted on the way there to the respective thread by shear forces increase, its diameter is reduced greatly and the pressure in its still liquid interior increases correspondingly greatly in inverse proportion to its radius due to the effect of surface tension. Due to the acceleration of the gas, its pressure drops in accordance with the laws of fluids. The conditions of the temperature of the spinning material, of the gas flow and its rapid acceleration are thereby coordinated to each other such that the thread reaches a hydrostatic pressure in its interior before its rigidification which is greater than the ambient gas pressure so that the thread splits and divides into a multiplicity of fine threads next to each other. Threads and air leave the chamber by means of a gap at the bottom in said chamber. The splitting takes place in or after the gap and in otherwise unchanged conditions in a surprisingly stable stationary manner at a specific point. In the region of high acceleration, gas- and thread-flow extend in a parallel fashion, the flow boundary layer around the threads being laminar. A continued fanning-out of the original thread monofilament without the formation of beads and tears is achieved. A multifilament of very much finer threads is produced from one monofilament using a gas flow of ambient temperature or a temperature situated somewhat above that.

The threads can be drawn further after the fanning-out point until they are rigid. This occurs very rapidly because of the suddenly produced larger thread surface. The threads are endless. The result can be threads of finite length to a minor degree due to technical interference influences, but the endless fine monofilaments are far more predominant.

The spinning materials used in DE 199 29 709 are meltable polymers. These are available of a synthetic or natural origin. Amongst the fibres based on natural raw materials, in particular those of the secondary growing raw material cellulose are of interest.

It has been shown that these methods of splitting threads can be applied also to lyocell spinning materials, in that cellulose is dissolved in N-methylmorpholine-N-oxide and water and pressed out through spinning borings into threads. Other solvents can also be used, NMMO having proved however to date to be the most suitable. The spinning material present as a solution, as described above, is spun out and the threads run through the air gap prescribed by the Laval nozzle, in which air gap they are drawn into thinner diameters, and proceed subsequently into a water bath in which the cellulose coagulates into the thread and the solvent passes into the water bath which is renewed because of the constant enrichment and the solvent is recycled.

A characteristic feature of the method according to the invention is that the accompanying gas flow, generally air, accompany the liquid solution material threads shortly after their exit from the spinning boring and draw them by transverse stress. As a result, they obtain an orientation and a cooling which both lead to increasing strength and a reduction in the very damaging tears, even as far as their complete prevention. Due to the mixing of the gas flow with the ambient atmosphere, generally also air, the gas flow is in fact slowed down and the threads are no longer subjected to the initial stress due to the higher speed of the same, but remain endless and continue to be carried by the air flow even in the case of tears. The threads are still of the initial soluble material if the precipitation of the cellulose has not already been commenced by injection of e.g. steam or water, These threads can be laid out on a travelling screen and be separated from the accompanying gas flow, as is known in methods for spinning non-woven fabrics, the gas (air) passing through the travelling screen and being suctioned off underneath the same and the threads, which have been laid out into a non-woven material, being only now supplied to the precipitation bath. An otherwise very precise implementation when spinning lyocell threads, beginning with fine capillary diameters for the spinning boring, subsequent air gap and its temperature and renewal and also the requirements for uniformity of the melt to be as free as possible of undissolved parts, which are permitted only in a few ppm, is dispensed with by the compulsory guidance of the threads by the drawing air flow. The thread forming and laying-out space is easily accessible because spacings of in fact 1 and 2 m can be produced between nozzle outlet and collecting strip.

Instead of laying out the threads from the solution material into a nonwoven fabric and subsequently bringing them into a precipitation bath, threads can be spun in the same way according to the method according to the invention and be separated from the accompanying gas flow, in that said gas flow is suctioned off laterally in the device, as provided similarly in the German patent 42 36 514. The individual threads or even a plurality as yarns are then supplied to precipitation devices for coagulation of the cellulose and are wound up on coils.

In contrast to the production of microthreads from synthetic polymers, such as polyethylene, polypropylene, polyamide, polyester and others, the fanning-out of the solution material jet to produce fine and microfine threads is only partly required. As noted before, after removal of the solvent by coagulation there are produced, corresponding to the cellulose content used in the solution material of already a good 10%, i.e. at the concentration which is entirely normal in the case of spinning methods for lyocell threads, threads in the region of below 10 μm in diameter without fanning-out, and it was shown that, only to a minor degree, also because of the particular viscosity behaviour of the NMMO-cellulose solutions which are very different from synthetic polymers, splitting into a plurality of threads next to each other is possible only to a minor degree and in the case of lower cellulose contents of the spinning material. Whilst a temperature increase is adequate in the case of synthetic polymers in order that, because of the effect of surface tension due to the increase in the internal pressure in the thread, the latter bursts and is fanned out into individual threads, damage to these sensitive materials at temperatures significantly above 100° C. results rapidly in the case of lyocell and subsequently the threads lack strength and other desired properties.

In contrast, it has been shown that other natural polymers can be processed into substantially endless threads corresponding to the method according to DE 199 29 709 and the one present here. They behave like synthetic polymers with respect to fanning-out or more like the cellulose materials for lyocell threads according to type.

Another polymer on a natural basis which can be spun into threads is polylactide PLA (polylactic acid), which is obtained on the basis of starch, e.g. cereal or maize starch, but also from whey or sugar. Materials made of PLA have the particular property that they are biodegradable, the degradation, i.e. the decomposition into $CO_2$ and $H_2O$ being able to be adjusted also for a specific temporal duration, and that they are body-friendly. Here too, it is achievable with the split spinning method to produce very fine threads, as can be obtained otherwise only with the disadvantages of the melt-blown method—large quantities of air must be increased to at least the melt temperature—the polymers generally being damaged.

A further objective is the increase in economic efficiency in the production of the threads due to a higher spinning material throughput and lower specific air and hence energy consumption. It has been shown that thread-forming plastic material solutions of natural or synthetic origin of very different types can be formed not only into threads, in that they are pressed out of round or profiled individual openings and subsequently are drawn by gas or air flows, but that split threads can be produced from films in an entirely similar manner as the monofilaments produced from individual openings. In addition, the spinning material is pressed out of a longitudinally extending slot-shaped nozzle, as mentioned above, into a chamber of a specific pressure, separated from the surroundings, to which gas, e.g. air, is supplied, the film passing into an area of rapid acceleration of the gas at the outlet from the chamber into a longitudinal gap. Underneath the acceleration zone, i.e. in the relaxation zone, the film fans out and there are then produced piles of substantially endless threads, although in contrast to those split from monofilaments these are of very different diameter and have knot-shaped thickenings. These are produced in the still molten-liquid state of the spinning materials and, within certain limits, can be adjusted by the main method parameters of melt temperature, melt throughput and drawing gases—generally air flows—within certain limits. Monofilaments which can then also be wound up cannot thus be produced by splitting films but in fact non-woven fabrics can. These spun non-woven fabrics made of irregularly laid-out monofilaments of different thread diameters can have advantages and are similar rather to natural materials in which a larger spectrum of different individual elements composing them, here for instance fibres and threads, thus occurs as in the case of leather and wood, different monofilaments of which produce their particular and generally advantageous properties.

In both processes, fanning-out of a monofilament or of a film, the temperature of the spinning material exerts the greatest influence because it determines viscosity and hence thread forming capacity and surface tension and hence pressure formation in the monofilament and in the film. Cooling of the thread too prematurely is therefore not desired, in contrast an increase in the temperature shortly before exiting from the spinning opening can be of advantage. The mechanism of fanning-out is similar in the case of the monofilament and the film but is not the same. In the case of monofilaments, the result is splitting when the pressure in the interior is greater than that in the surrounding gas flow. This occurs during the split spinning method as a result of the fact that the thread diameter reduces due to an accompanying gas flow in addition to the generally small influence of gravity, said gas flow constantly accelerating and the pressure in the gas reducing according to the laws of fluids. Due to the surface tension, the pressure in the liquid monofilament becomes greater. In monofilaments, the result is fanning-out due to bursting of the monofilament when the liquid skin can no longer hold the thread together. During spinning out of films, different pressures are produced across the film width and in fact they are higher at the edges due to the surface tension because of the curvature there. Such films are fundamentally unstable even if the gas flow is maintained according to the invention in a laminar fashion for as long as possible. The result is furrows, striations across the film width and ruptures with the formation of thread-shaped or strip-shaped individual parts, also termed ligaments.

The area of high acceleration and pressure drop in the gas flow is produced according to the invention in the form of a rotation-symmetrical or longitudinally extending Laval nozzle with a convergent contour towards a narrowest cross-section and then rapid widening, the latter in fact in order that the newly formed monofilaments which run beside each other cannot adhere to the walls. In the narrowest cross-section, in the case of corresponding choice of the pressure in the chamber (in the case of air, approximately twice as high as the ambient pressure behind it), the speed of sound can prevail, and in the widened part of the Laval nozzle, supersonic speed.

For the production of thread non-woven fabrics (spun non-woven fabrics), spinning nozzles with spinning borings disposed in lines and in a rectangular form or with a slot form and Laval nozzles with a rectangular cross-section are used. For the production of yarns and for particular types of non-woven fabric production, round nozzles with one or more spinning borings and rotation-symmetrical Laval nozzles can also be used.

The advantage of the present invention resides in the fact that microthreads in the range below 10 μm, for example between 2 and 5 μm, can be produced in a simple and economical manner, which is accomplished in the case of simple drawing for instance by the meltblown method only with hot gas (air) jets which are heated above the melting point and hence requires significantly more energy. In addition, the threads are not damaged in their molecular structure by excess temperatures, which would lead to reduced strength, as a result of which they can then often be rubbed out of a textile web. A further advantage resides in the fact that the threads are endless or quasi endless and do not protrude out of a textile web such as a non-woven fabric and cannot be detached as bits of fluff. The device for executing the method according to the invention is simple. The spinning borings of the spinning nozzle, just as the slot nozzle, can be larger and hence less susceptible to faults. The Laval nozzle cross-section does not require in its precision the narrow tolerances of the lateral air slots of the meltblown method. In the case of a specific polymer, only the solution temperature and the pressure in the chamber require to be coordinated to each other and with a given throughput per spinning boring and the geometrical position of the spinning nozzle relative to the Laval nozzle, the result is fanning-out. In the case of lyocell, the solution thread is thinned to the desired diameter, the fanning-out only occurs sporadically.

It is a development of the invention to cool the solution cone, which is round as a monofilament or cuneiform as a film, as little as possible before the fanning-out and furthermore to heat it to a higher temperature. For this purpose, heating devices, which are screened relative to the gas flow, are fitted on both sides of the outlet openings—row of borings or slot. These heating devices direct heat on the one hand in the region of the outlet opening to the spinning material from the exterior and, where it permits a higher speed and hence higher heat transition, give it a temperature increase, on the other hand the heating devices are of the type that transmit heat by radiation to the cone-shaped or cuneiform part of the spinning material which is being formed.

Embodiments of the invention are illustrated in the drawing and are described in more detail in the subsequent description. There are shown FIG. 1 a schematic section representation of a part of a device for producing threads according to the invention, FIG. 2 a perspective view of a device according to the invention according to an embodiment with line nozzle and spin borings for producing lyocell non-woven fabrics from microthreads, FIG. 3 a photo of a microscopic picture of PP split threads, produced according to example 3 by splitting a melt film, and FIG. 4 a photo of PP split threads in conditions corresponding to FIG. 3, produced by splitting monofilaments.

In FIG. 1, a section through the lower part of a spinning nozzle 1 and an assigned Laval nozzle is illustrated, this section applying both for a rotation-symmetrical spinning nozzle, which spins a thread or a monofilament, and for a rotation-symmetrical Laval nozzle, and for a slot-shaped or rectangular spinning nozzle, which spins a film, and corresponding to a rectangular Laval nozzle. There can also be provided a spinning nozzle with a plurality of spinning borings disposed in a row with corresponding longitudinally extending Laval nozzle. Underneath the spinning nozzle 1 there is located a plate 11, 11' with a gap 12' which, observed from the spinning nozzle, has a convergent and then slightly divergent configuration and widens out sharply at the lower edge of the plate 11, 11', as a result of which the Laval nozzle is formed. The spinning nozzle or the spinning borings of the spinning nozzles terminate shortly above the Laval nozzle or in the upper plane of the plate 11, 11', if necessary the spinning nozzle 1 can also protrude slightly into the opening 12.

Between the spinning nozzle 1 and the plate 11, 11' there lies a sealed chamber to which gas is supplied, for example by a compressor, corresponding to the arrows 6, 6'. The gas, which can be air, has normally ambient temperature but can also have a somewhat higher temperature, for example 70° to 80°, because of the compression heat from the compressor. The spinning nozzle 1 is surrounded by an insulation arrangement 8, 8' which serves for screening the spinning nozzle heated to spinning temperature against heat losses, an air gap 9 being advantageously provided also between the spinning nozzle 1 and the insulation arrangement 8, 8'. The spinning nozzle 1 has an outlet opening 4, in the region of which a heating device 10, 10' is fitted which in the embodiment is configured as a flat heating strip and which is insulated in an advantageous manner relative to the insulating arrangement 8, 8' in order to avoid heat losses by parts 13 and 13'. The chamber underneath the plate 11, 11' normally has ambient pressure, i.e. atmospheric pressure, whilst the gas in the chamber between the spinning nozzle 1 and the plate 11, 11' is at an increased pressure. In the case of directly subsequent further processing into non-woven fabric, yarns or other thread structures, the chamber underneath the plate 11, 11' can have a pressure which is somewhat increased relative to atmospheric pressure, for example by a few millibars, which is required for the further processing, such as laying of the non-woven fabric or other thread collecting devices.

A polymer solution 2, i.e. for example lyocell prepared by dissolving cellulose in a solvent, such as amine oxide, flows along the illustrated arrow 3 towards the outlet opening 4 of the nozzle 1. A thread 5 or a film is formed which, in its further course because of the gas flow, which extends along the illustrated arrows 6, 6', coming laterally from above between the contour of the faces of the plate 11, 11' and the outer faces 7, 7' of the insulation arrangement 8, 8', is reduced in diameter or in width. The heating device 10, 10' heats the capillary of the outlet opening 4 from the exterior and, by corresponding lengthening, can essentially heat the spinning material flowing past it by radiation with its lower part. The thread 5 or the film passes into the constriction 12' of the flow cross-section formed by the parts 11, 11' of the plate for the gas flow 6, 6' according to the type of Laval nozzle with the narrowest cross-section at 12. Until there, the flow velocity of the gas increases constantly and the speed of sound can prevail in the narrowest cross-section 12 if the critical pressure ratio for instance in the non-operative state of the gas $p_1$ in the chamber above the plate 11, 11' relative to the pressure in the narrowest place $p_e$ is exceeded. Due to the widening of the Laval nozzle towards the chamber with the pressure $p_2$ beneath the plate 11, 11', even supersonic speeds can be produced with supercritical pressure ratios. In general, the Laval nozzle widens very sharply immediately after the narrowest cross-section 12 or shortly thereafter in order to avoid adhesion of the threads to the plate 11, 11' due to the fanning-out beginning in this region shortly beneath the Laval nozzle.

In the illustrated example, the thread 5 splits or fans out when the thread casing can no longer hold together the solution thread against the internal pressure which has increased with the thread constriction. The monofilament then divides into individual threads which cool rapidly because of the temperature difference between the solution and the cold gas or air and the suddenly greatly increased surface of the monofilaments, relative to the thread material. Thus a specific number of very fine, substantially endless monofilaments are produced. In the case of a lyocell solution, the phenomenon of fanning-out frequently does not occur or only here and there, i.e. in FIG. 1 the thread which is spinning out would continue. The thread is drawn by the laminar gas flow at a constantly increasing speed so that in conclusion the result is fine threads because of the proportion of cellulose being at or below 10%.

The soluble film also rips shortly beneath the Laval nozzle, the pressure ratios in the film before the fanning-out being different across the width and the film becoming unstable. Shortly before fanning-out, the result is furrows and striations across the width of the film and then ruptures of the threads with small, but larger diameters.

It follows from the nature of splitting processes of this type that the number of threads produced after the fanning-out point, which can still be in the Laval nozzle or for example 5 to 25 mm under the narrowest point of the Laval nozzle, may be non-constant. Because of the short route which thread or film and gas cover together up to the fanning-out point or up to the final drawing of the thread, the flow boundary layer around the thread is laminar. The air from the incoming pipes is also directed in as laminar a fashion as possible to the area of the fanning-out. This has the advantage of smaller flow losses but also of a more uniform temporal course of the fanning-out. The accelerated flow, as occurs in the cross-section of the laval nozzle, remains laminar and can even be laminated if a certain turbulence prevails in advance.

Figure 2:
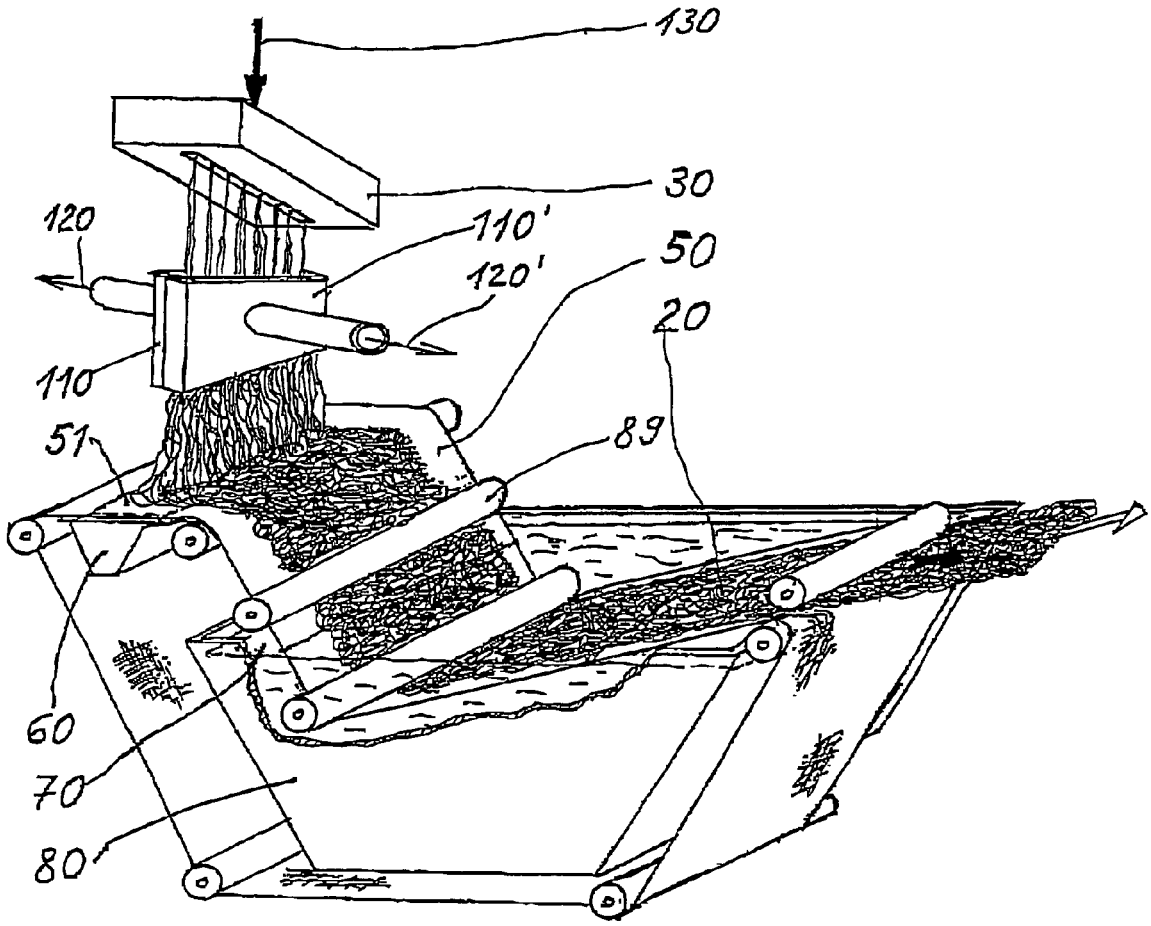

FIG. 2 shows the perspective view of a system for the method according to the invention in which a lyocell material 130 is supplied to a device 30 and a non-woven fabric 20 is obtained therefrom. The device 30 for producing substantially endless threads corresponds to the arrangement according to FIG. 1, a plurality of spinning nozzles or spinning borings being disposed in a row corresponding to FIG. 1 and the Laval nozzle extending longitudinally or respectively having a rectangular configuration. Monofilament threads exit from the individual spinning borings, are tapered by the transverse stresses of the gas flow and fan out if necessary, however less with lyocell, in the lower part of the gap of the non-illustrated Laval nozzle or somewhat thereunder into a plurality of threads. With lyocell, essentially monofilaments are spun.

The airflow accompanying it leads it to a collecting strip 50, where the threads which are still dry are laid down. This is possible in the present method and has great advantages relative to lyocell methods in which the threads are introduced immediately after a short air gap of a few cm into the precipitation bath, generally of water. Underneath the laying-out stretch in the dry place, there is located a suction device, illustrated by the box 60 as is common with spun non-woven fabric methods so that the accompanying air is discharged by non-illustrated suction devices. In order to implement an introduction beneath the level of the precipitation bath 70, without the threads detaching from the travelling screen, a precipitation bath liquid, predominantly water, can also be suctioned through the travelling screen at this point, not shown in detail, or a roller 89 with or without contacting the water surface is present which presses the non-woven fabric into the precipitation bath 70. While the collecting strip 50 is moved back, the non-woven fabric 20 proceeds for further processing thereof, for example by calendering, drying and further processes such as water jet compacting.

The air can be in part discharged already in advance along the arrows 120, 120', the boxes 110, 110' thereby have non-illustrated air-permeable faces orientated towards the threads.

Suction devices of this type laterally to the thread bundle can be used in a particular manner if the threads are not intended to be processed into a non-woven fabric but into an endless yarn, which is intended to be wound onto rolls or cut into staple fibres, respectively after solvent and cellulose material have been separated from each other in advance by coagulation.

It is a particular peculiarity of the method according to the invention that, after their exit from the spinning borings and possibly after their splitting, the threads experience shear forces due to the gas flow, generally air flow, extending substantially parallel to them. Hence it differs from the forces otherwise applied for spinning by winding or other types of take-off devices. The spinning solution from the spinning borings withstands only low tensile forces and it is therefore not possible with methods according to the state of the art to produce very fine threads because the spinning material can be drawn to a thread of a small diameter only in the air gap between the nozzle outlet and the coagulation bath, and no longer thereafter. According to the present method, the forces required for the forming are transverse stress forces (in addition to the very low effect of gravity) which do not stress the thread as tensile forces across the thread cross-section, as a result of which tearing scarcely occurs.

The coagulation of the dissolved thread polymer, here cellulose for lyocell threads, in a solvent, here NMMO, can be introduced already between the spinning device 30 and the laying-out surface 51, in that water mist or steam are injected laterally against the thread bundle, i.e. for instance where the previously described suction boxes for air 110, 110' are fitted and hence, precisely in the reverse manner to the discharged air, now moist air or steam are introduced into the thread bundle. This has the effect that the threads are enriched in the cellulose proportion on their exterior already in front of the system and binding to each other is not as great as when they are laid out to form a non-woven fabric without the same. The non-woven fabric is then introduced into a precipitation bath, the result being self-binding subsequently due merely to pressure rollers or between a drum, also heated, and the travelling screen. Because the produced lyocell threads are soft and adhere already to each other if they are connected to each other at only low pressure. This autogenic connection is a further particular advantage in the production of non-woven fabrics made of lyocell threads. If the coagulation is already introduced, then the binding is not so strong and softer non-woven fabrics with a textile texture are obtained relative to the previously non-sprayed non-woven fabrics drawn only through the precipitation bath which are more compact and have a harder paper texture.

It is understood that yet further steps of coagulation or washing out of the solvent can be added after the trough illustrated in FIG. 2. For this purpose, perforated cylinder washing machines can also be used, as are used in the textile industry, the non-woven fabric looping round the perforated cylinder in a specific circumferential segment and the water being withdrawn axially through the non-woven fabric and the perforated cylinder casing and being supplied once again to the bath or for separation of water and solvent, for example NMMO. Subsequently, the non-woven fabric must be dried, for which purpose perforated cylinder dryers can be used. Since in general a high shrinkage of the lyocell threads occurs here, the non-woven fabric can be guided between a suction cylinder which is subject to a warm air flow and a travelling screen looping round the latter and moving at the same speed.

EXAMPLE 1

Via a worm press (extruder), a solution of 13% cellulose in an aqueous NMMO solution of 75% and 12% water was supplied to a spinning device comprising a spinning nozzle with a hole and a round Laval nozzle, the single spinning boring having had a diameter of 0.5 mm. The solution is produced on an industrial scale and supplied directly via pumps delivering said solution and dosing the spinning device. The temperature of the lyocell spinning material at he extruder outlet was 94° C. At the lower part of the conical nozzle tip, an electrical resistance heating device was fitted for heating thereof at a power between 50 and 300 W. The drawing of the thread occurred by air at room temperature of approximately 22° C., the pressure, measured before the acceleration in the Laval nozzle, was set between 0.05 and 3 bar above atmospheric pressure. The outlet of the lyocell material from the nozzle tip was only varied a little and lay 1 to 2 mm above the plane where the Laval nozzle is constricted, with further adjustments precisely in this plane or even 1 to 2 mm thereunder, therefore further downstream. The Laval nozzle had a width in the narrowest cross-section of 4 mm and a total length, measured from the plane where its constriction begins up to the greatest widening shortly after the narrowest cross-section, of 10 mm.

Table 1 shows the settings 1-11. The particular influence of the heating device 10 of the nozzle tip is detected, as a result of which the spinning material obtained an increased temperature before its exit from the spinning boring, and in fact significantly above its original temperature of 94° C. The threads were only partly split for individual settings, in particular not substantially at lower air pressure and lower temperature. One is convinced of this, when comparing the thread speed, calculated from the measured throughput of the spinning material and the average final thread diameter, corrected by the diameter reduction by means of the solvent removal, with the highest occurring air speed, i.e. that in the Laval nozzle gap (if no supersonic speed occurs thereafter). If this is higher, then the threads can be split—the more the speeds differ. If it is smaller than this calculated average thread speed, then they are not split in the majority, if both are for instance equally large, then some are split, some are not, because everything applies respectively on average. The observation is general that lyocell threads tend to split less than was noticed already initially in comparison to the synthetic polymers such as polypropylene.

Even in the case of large throughputs per spinning boring above 4 g/min, threads of 10 μm and below were able to be produced. A higher air pressure $p_1$ leads within specific limits to finer threads until the nozzle tip was cooled greatly by increased heat dissipation to the air flow and the splitting also occurred with more difficulty. The influence of the increased air speed due to increased air pressure before the Laval nozzle can be partially compensated for by increased air temperature at the nozzle tip. In addition to this, influence can be exerted by the position of the nozzle tip relative to the Laval nozzle. The two main influence values, the temperature of the spinning material and the transverse effect of the air flow, are also hereby decisive for the splitting.

TABLE 1

| No. | $M_0$ g/min | $p_1$ mbar | $P_h$ W | $d_{50}$ μm | CV % |
|---|---|---|---|---|---|
| 1 | 3.4 | 80 | 79 | 26.2 | 26 |
| 2 | 3.4 | 150 | 97 | 24.9 | 20 |
| 3 | 3.4 | 150 | 116 | 19.0 | 24 |
| 4 | 3.4 | 150 | 130 | 13.2 | 29 |
| 5 | 3.4 | 200 | 130 | 12.0 | 17 |
| 6 | 3.4 | 100 | 130 | 10.1 | 64 |
| 7 | 11.1 | 400 | 370 | 24.4 | 47 |
| 8 | 6.65 | 1000 | 370 | 13.4 | 38 |
| 9 | 3.68 | 1500 | 276 | 11.1 | 36 |
| 10 | 2.33 | 1500 | 280 | 8.3 | 33 |
| 11 | 4.57 | 3000 | 208 | 9.1 | 54 |

EXAMPLE 2

In a device such as that in Example 1, a solution of 8% cellulose in 78% NMMO and residual water of 14% was spun from spinning borings with a diameter of 0.6 mm. The temperature of the solution at the extruder outlet was 115° C. and, in the distribution chamber of the solution to in total twenty spinning borings, was 114° C. The heating power of the heating device on both sides of the nozzle tip was 450 W. The throughput per spinning boring was 3.6 g/min.

The following thread diameters of the substantially endless lyocell threads were produced dependent upon the pressure of the unheated air.

TABLE 2

| No. | $P_1$ mbar | $d_{50}$ μm | $d_{min}$ μm | $d_{max}$ μm | CV % | $u_{Le}$ m/s | $u_{F50}$ m/s |
|---|---|---|---|---|---|---|---|
| 5 | 160 | 8.5 | 2.8 | 21.1 | 59 | 156 | 67 |
| 7 | 200 | 8.0 | 3.7 | 14.7 | 39 | 173 | 78 |
| 9 | 250 | 9.7 | 2.7 | 16.3 | 39 | 192 | 52 |
| 11 | 300 | 9.2 | 5.1 | 18.4 | 43 | 209 | 61 |

Despite increasing air pressure $p_1$, measured before the Laval nozzle, the threads become thicker again from $p_1$=200 mbar, which can be attributed to a quicker cooling due to the higher air flow.

The speed of the air in the narrowest cross-section of the Laval nozzle $u_{Le}$ and the speed $u_{F50}$, which a lyocell thread with a subsequent average diameter $d_{50}$ would have before entry into the precipitation bath, are also cited. If this is greater than $u_{Le}$, then a fanning-out can occur. For this purpose, the values would however have to differ very noticeably, since a finer diameter than corresponds to the maximum calculated air speed during the spinning process, i.e. to that in the narrowest gap of the Laval nozzle, can also be produced at this position, due to lateral peeling of the main flow or depleted cellulose concentration.

By means of an increase in temperature of the solution before exiting from the spinning boring, the thread diameter can be further reduced, admittedly in this case limits are set on the temperature, because the solution decomposes, so that the shortest possible dwell times with increased temperature by means of corresponding configuration of the melt chambers in the lower spinning nozzle part are selected. At a temperature there of 123° C. instead of the previous 114° C., the proportion of individual threads with $u_F > u_{Le}$ in one setting incidentally increased approximately like No. 7 in Table 2.

The nozzle borings of this longitudinal nozzle (20 borings in one row) protruded 2 mm into the Laval nozzle in the flow direction. Furthermore, there remain 3 mm of a constricting stretch up to the narrowest cross-section of the Laval nozzle. Thus a narrowing gap existed on both sides of the thread bundle. By means of this, a constantly accelerated gas flow is produced over a very short distance from the incoming flow up to the narrowest cross-section of the Laval nozzle. In the region of the thread formation, after its exit from the spinning boring, a laminar flow prevails. Even with small disturbances, such a strong constriction and hence flow acceleration causes a renomination, as is known in nozzle flows, with the effect that the thread, editing slowly from the spinning boring, is drawn with constantly increasing gas (air) flow $u_L$ and likewise constantly increases in its speed $u_F$. Oscillating flow impulses of a turbulent nature would disturb this process and it could come about as in other methods which have become known for the spinning material thread (e.g. from a lyocell solution) to unravel and the threads would no longer be substantially endless. The forming into running lengths of a few mm in the case of the method according to the invention occurs in addition in the case of high transverse stresses increasing up to the narrowest cross-section—a reason for substantially tear-free thread formation, because the speed $u_L(x)$ has its maximum=narrowest cross-section Laval nozzle beneath, not next to the material outlet.

By setting specific values for the throughput of the spinning material, its temperature and the air speed in the flat gap in the case of longitudinal nozzles or in the annular gap in the case of round nozzles, it is possible, as Examples 1 and 2 show, to control the diameter of the substantially endless threads. The throughput per spinning boring is as in all mentioned cases higher than in the case of meltblown methods for lyocell which have become known. The reason is the high transverse stresses due to the greatly accelerated flow, namely a starting flow, with very thin boundary layers at the thread.

EXAMPLE 3

Figure 3:
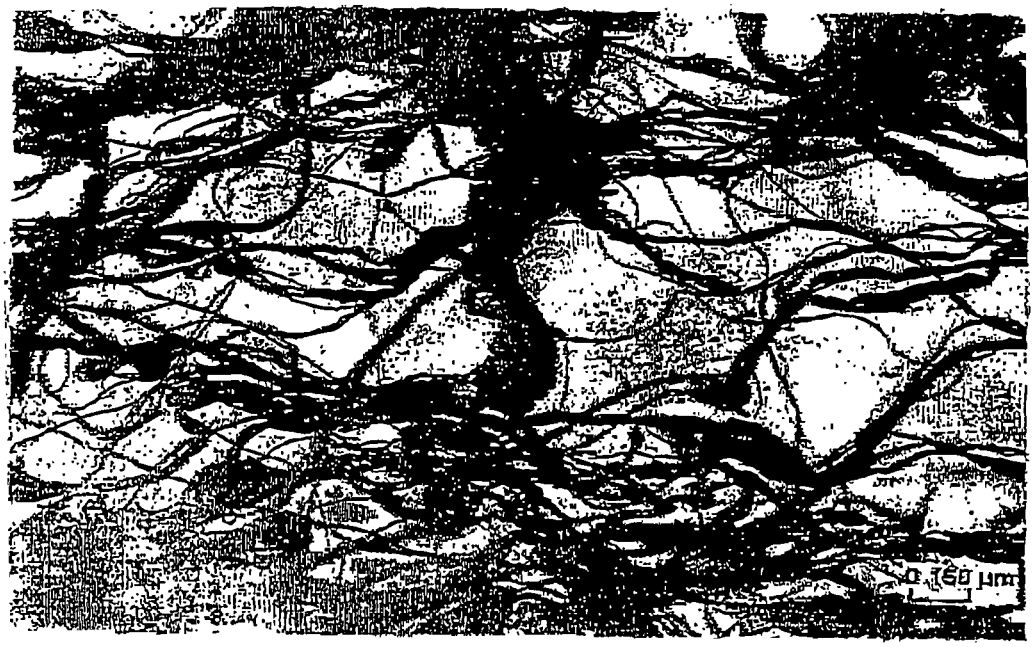
Figure 4:
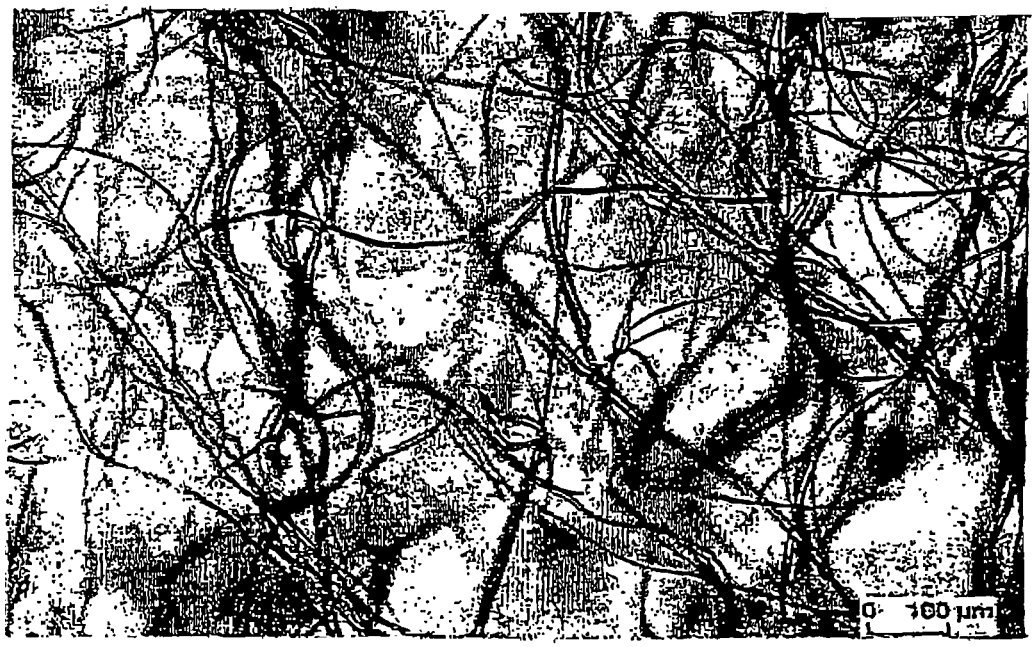

In a spinning device similar to that shown in FIG. 1, a polypropylene melt with a temperature of 355° C. was spun from a slot of 0.9 mm width and 20 mm length as a film, from a spinning nozzle terminating at the bottom as a web. Air served as drawing gas for the film. With a throughput of 11.5 g/min and a pressure of the air of room temperature of 20° C. and 250 mbar, threads with an average diameter of 5.2 μm were produced with a scatter of s=1.9 μm, corresponding to a variation coefficient of CV=37%. The thick knotted places in the non-woven fabric were thereby not included in the measurement. The produced non-woven fabric is illustrated in FIG. 3, which shows the photo of a microscopic picture of the PP split threads according to Example 2. In FIG. 4, polypropylene split threads are shown for comparison, which threads were spun under otherwise identical conditions from a round spinning boring with a diameter of 1 mm and with a throughput per boring of 3.6 g/min. The threads in FIG. 4 had an average diameter of 8.6 mm, their variation coefficient was 48%.

The present description of the method according to the invention and its devices can also be applied to other solvent-spun thread polymers, for example also to conventional viscose or rayon threads and their further processing into non-woven fabrics or yarns. In addition to the mentioned characteristic features of the spinning reliability, it should be further mentioned that the device is simple, the energy consumption compared to meltblown methods is very much less and surprisingly large diameters for spinning borings and slots can be used because of the high drawing due. to the transverse forces at speeds up to speeds of sound and even above, by means of their production in a Laval nozzle. Because of this, impurities in the spinning material are no longer so critical with respect to thread tears. In the case of lyocell threads, higher proportions of hemicellulose can b)e processed into threads, and also the polymerization degree of the cellulose (DP) can be less, as a result of which the raw materials become generally cheaper, simply because no high tensile forces are exerted on the lyocell threads in their production state as fine threads from the solution material. The fact that basically only cold air or air with waste heat from air atomisation is used contributes very much to the energy saving of the method in the case of lyocell, but particularly in the case of solution polymers to be spun at a higher temperature.

The invention claimed is:

1. A method for producing endless fine threads from a spinning material made of cellulose dissolved in a solvent, in which the dissolved cellulose is spun from at least one spinning orifice and the spun thread is drawn by gas flows which are constantly accelerated to a high speed by means of a Laval nozzle, the gas flow in the region of the fiber formation being substantially laminar, at least one of the temperature of the spinning material, the temperature of the thread exiting from the spinning orifice, the pressure before the Laval nozzle and the pressure after the Laval nozzle is controlled such that the thread reaches a pressure in its interior before solidifying which is greater than the gas pressure surrounding it, in such a manner that the thread splits and fans out into a multiplicity of fine threads, whereby in the drawing region water or steam is injected in order to start coagulation.

2. The method according to claim 1 wherein the maximum of the speed of the gas flow is beneath the outlet of the spinning material from the spinning orifice.

3. The method according to claim 1 wherein the gas flows drawing the thread are at ambient temperature or at a temperature which is conditioned by their production and supply.

4. The method according to claim 1 wherein the chamber after the Laval nozzle is at ambient pressure or, in the case of further processing of the threads, is at a pressure somewhat above ambient pressure which is required for the further processing.

5. The method according to claim 1 wherein the ratio of the pressures in the chamber above and below the Laval nozzle when using air is selected between 1.02 and 3, dependent upon the throughput and temperature of the spinning material.

6. The method according to claim 1 wherein the spinning material in the region of the outlet position and/or the thread exiting from the spinning orifice is heated.

7. The method according to claim 1 wherein a multiplicity of threads is spun and if necessary fanned out, which threads are laid out into a non-woven fabric or are further processed into yarns.

8. The method according to claim 1 wherein the pressure ratios before and after the Laval nozzle are set such that the gas flow in the Laval nozzle reaches speeds up to and above the speed of sound.

9. The method according to claim 1 wherein threads spun from a cellulose solution are laid out in a dry place and subsequently guided through a precipitation bath.

10. The method according to claim 1 wherein, in the drawing region of the threads, water or steam is injected in order to control the binding of the threads to each other into a non-woven fabric.

11. The method according to claim 1 wherein the cellulose content is less than about 13% by weight.

* * * * *